US005220777A

United States Patent [19]

Badiali et al.

[11] Patent Number: 5,220,777

[45] Date of Patent: Jun. 22, 1993

[54] METHOD AND DEVICE FOR PNEUMATIC THREADING IN A DOUBLE HOLLOW PIN SPINDLE OF A DOUBLING FRAME

[75] Inventors: Roberto Badiali; Vittorio Colussi; Gianpaolo Canova, all of Pordenone, Italy

[73] Assignee: SAVIO S.p.A., Pordenone, Italy

[21] Appl. No.: 817,515

[22] Filed: Jan. 7, 1992

[30] Foreign Application Priority Data

Jan. 8, 1991 [IT] Italy ..... 00025 A/91

[51] Int. Cl.[5] ..... D01H 9/18

[52] U.S. Cl. ..... 57/279; 57/58.52; 57/58.83; 57/281

[58] Field of Search ..... 57/279, 261, 266, 281, 57/58.52, 58.83

[56] References Cited

U.S. PATENT DOCUMENTS

| | | | |
|---|---|---|---|
| 3,029,587 | 4/1962 | Kresslein | 57/58.52 |
| 3,119,224 | 1/1964 | Kocks | 57/58.52 |
| 3,636,698 | 1/1972 | Nakahara et al. | 57/279 |
| 4,047,372 | 9/1977 | Horstmann et al. | 57/279 |
| 4,199,929 | 4/1980 | Vessella | 57/279 |
| 4,355,500 | 10/1982 | Yanobu et al. | 57/279 |

FOREIGN PATENT DOCUMENTS

| | | | |
|---|---|---|---|
| 0026162 | 9/1980 | European Pat. Off. . | |
| 1227367 | 10/1966 | Fed. Rep. of Germany | 57/58.52 |
| 3109193 | 2/1982 | Fed. Rep. of Germany | 57/279 |
| 3614576 | 10/1986 | Fed. Rep. of Germany | 57/279 |
| 1905049 | 9/1989 | Fed. Rep. of Germany . | |
| 2398131 | 7/1977 | France . | |
| 2001354 | 7/1978 | United Kingdom . | |

*Primary Examiner*—Joseph J. Hail, III

*Attorney, Agent, or Firm*—George P. Hoare, Jr.

[57] ABSTRACT

This invention relates to a method for pneumatic threading in a double-twisting doubling frame having a double hollow pin twisting spindle, in which the two thread feeding bobbins are disposed coaxially, one above the other, in the head of the spindle, and each individual bobbin engages its own hollow pin, this method providing for removing the initial length of thread from the lower bobbin in order to advance it into the hollow pin of the upper bobbin and also removing the initial length of thread from the upper bobbin and holding together the two said initial lengths of thread so that they rest on the inlet of the upper hollow pin, a head connected to a source of compressed air coming towards and being pressed against said upper hollow pin, allowing for both the lateral displacement of the braking device and the injection of compressed air for pneumatic threading.

3 Claims, 6 Drawing Sheets

Figure 1:
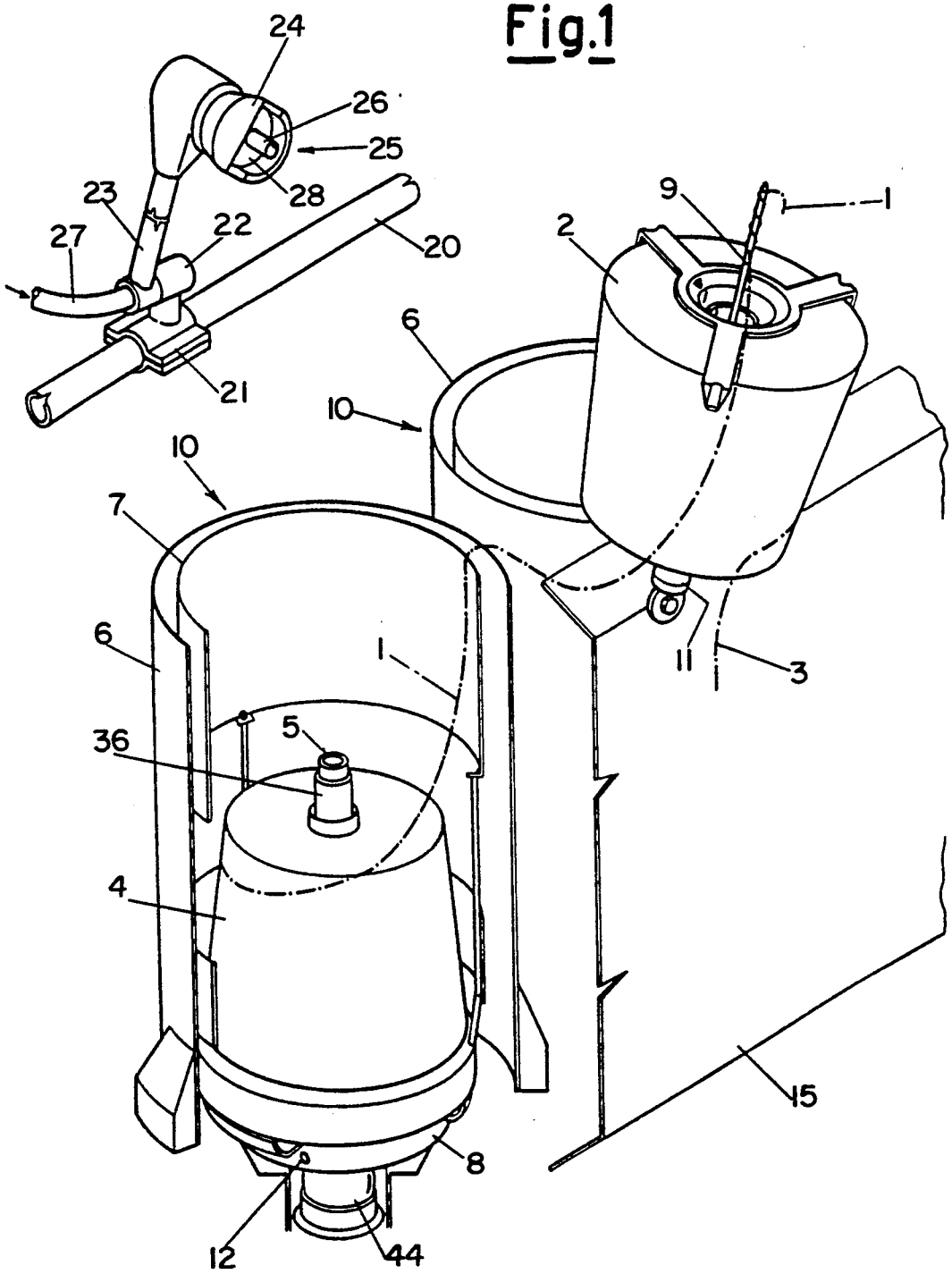

25
25a
23
22
24
28
11
1
14
1
21
19
3
16
20
7
3
42
2
5
29
36
1
40
32
31
30
4
10
35
33
34
37
6
38
39
18
41
8
12
44

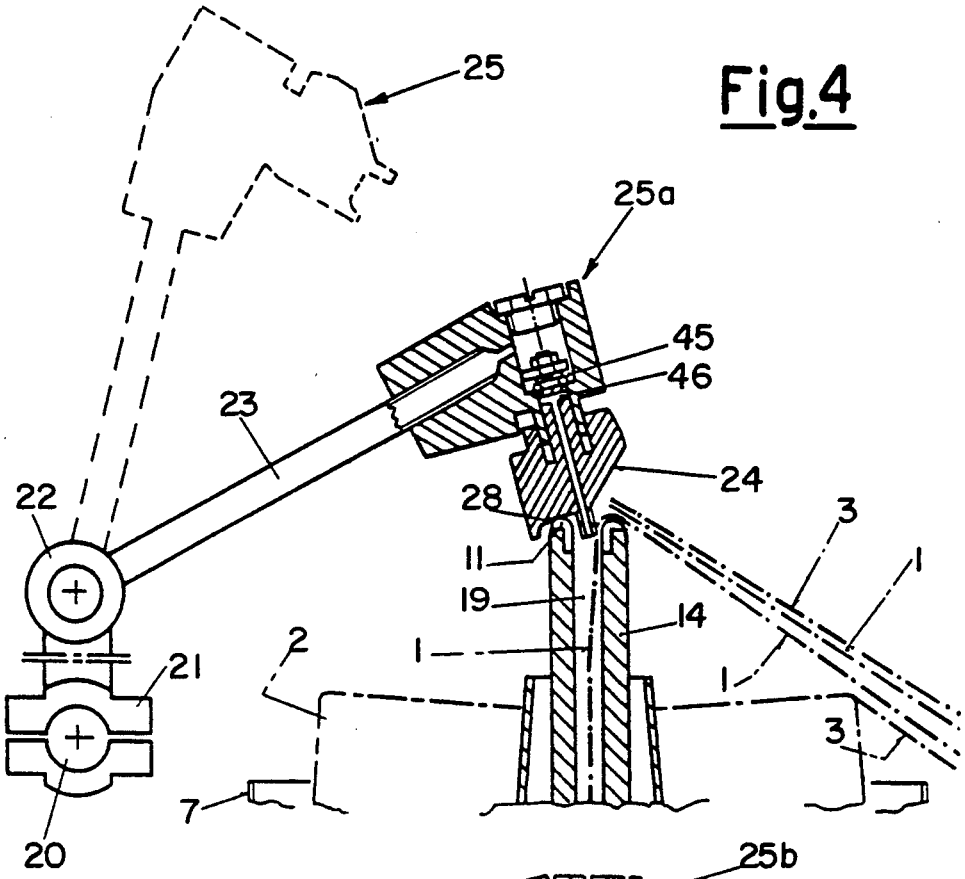
Fig.4
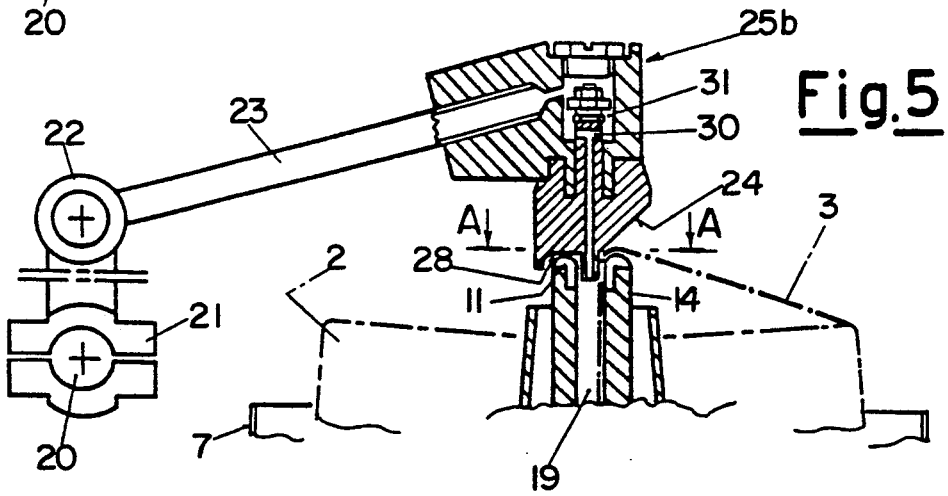
Fig.5
Fig.6
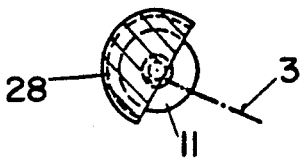

3
2
19
7
16
1
42
1
40
4
36
31
32
43
30
35
33
34
37
39
38
18
41
47

METHOD AND DEVICE FOR PNEUMATIC THREADING IN A DOUBLE HOLLOW PIN SPINDLE OF A DOUBLING FRAME

This invention relates to a method for pneumatic threading in a double-twisting doubler frame having a double hollow pin twisting spindle, and a device for carrying out this method.

The invention relates particularly to a double-twisting spindle in which the two thread bobbins each engage their own hollow pin with the threads which are wound upwards, each thread unwound from its own bobbin directly entering its own hollow pin without advancing during its course into the space surrounding the other bobbin, as described and claimed in European Patent Appln. Public. No. 0,417850 of the same Applicant.

The invention provides for pneumatic threading in a double-twisting spindle for twisting together a plurality of threads in order to form a ply yarn. These threads can be of any desired composition or structure and in the description and in the claims will be referred to simply as threads or yarns, or ply yarns, these terms being used interchangeably and including all filaments or filament complexes or fibres, both natural and synthetic.

The braking device, long since known per se, will also be discussed hereinafter, this device guaranteeing constant control and maintenance of the tension of the thread passing into the central bore of the hollow pin of the spindle. This braking device consists of two semi-capsules (expansion olives), one normally moving into the other, and each advantageously placed in the interior of the hollow pin of the spindle in an intermediate position of the central conduit. The hemispherical end heads of the two semi-capsules oppose the said central conduit, dividing and closing it in two points, as is well known in the art.

The two semi-capsules are moreover held in position by at least an elastic force, the value of which is adjustable, thereby regulating the tension imparted to the passing thread.

In this invention, the braking device is situated in the central conduit section associated with the stationary part of the lower hollow pin of the twisting spindle. Each of the yarns passes into this lower hollow pin, the yarns having to be twisted together to produce the ply yarn.

Various types of spindles are known in double twisting and it is also known that the introduction of the yarn into the central bore of the hollow pin of the spindle always presents a problem in that it is a difficult and troublesome operation. Various methods and devices for the various types of spindles for doubling frames have been studied in an attempt to simplify these operations.

However, in the case of the spindles of a double-twisting doubling frame having a double central hollow pin, in the known prior art, the problem of a method and a device for effecting pneumatic threading remains unsolved. It should be noted that in the case of a doubling frame having a double hollow pin spindle disclosed in the improvement described and claimed in the abovementioned European Patent Appln. Public No. 0 417 850, the threads are removed from the individual superimposed feeding bobbins without even minimum interference contact before entering the lower hollow pin in the interior of which the braking device is housed. This has therefore proven very advantageous in practice, in that the threads are not subjected to wear of any kind, with the positive result that a high-quality ply yarn is obtained.

Whereas in the case of double-twisting doubling frames having a single central hollow pin, the automatic operation of pneumatic threading is already a well-established technique, in the case of spindles having a double central pin, the operating phase for replacing the empty bobbins with other full bobbins, or the phases for resuming the twisting process in the event of interruption as a result of breaking of the thread, are effected, in the prior art, by means of extremely tedious and laborious manual operations for the production of a multiple ply yarn.

The Applicant has therefore studied, developed and tested a method and an injection device for pneumatic threading in a double central hollow pin spindle for double twisting, wherein the pressurised fluid is supplied transiently and from an upper position through the vertical stationary part.

More precisely, the Applicant has studied and developed a double-twisting spindle having a double central hollow pin provided with a device for pneumatic threading of the threads, wherein the pressurised fluid is supplied transiently through a conduit going as far as a head positioned as close as desired to the twisting spindle.

The solution according to the invention essentially comprises the following advantages:

- a double-twisting spindle having a double central hollow pin can be provided with pneumatic threading whenever it is necessary to resume the twisting process;
- tedious manual operations can be automated with a view to obtaining a ply yarn at reduced running costs;
- the bobbins can be replaced in a rapid and simple manner.

This and other advantages are offered by this invention, which provides for a method for pneumatic threading in a double-twisting doubling frame having a double hollow pin twisting spindle, in which the two thread feeding bobbins are disposed coaxially, one above the other, in the head of the spindle, and each individual bobbin engages its own hollow pin with the thread which is wound upwards, each thread directly entering the hollow pin of its own bobbin without advancing during its course into the space surrounding the other bobbin, this method including the following phases of operation:

- removing the initial length of the thread being unwound from the lower supply bobbin, which is already positioned around the lower hollow pin and in the head of the spindle, in order to insert this initial length into the central bore of the upper hollow pin around which the upper supply bobbin is already positioned;
- removing the initial length of the thread being unwound from the upper supply bobbin in order to hold it together with the said initial length from the lower bobbin;
- resting the two abovementioned initial lengths of thread, which are held together, on the inlet of the central bore of the upper hollow pin;

displacing a head connected to a source of compressed air and moving it towards the inlet of the central bore of the upper hollow pin;

forcing the said head to move the upper hollow pin downwards, said upper hollow pin, via its end bushing part, being pushed down towards and into the sleeve integral with the lower supporting seat of the expansion braking device in order to allow the said device to be displaced laterally in order to free the central bore of the lower hollow pin;

injecting compressed air through an injection nozzle, the initial lengths of thread from the two bobbins being carried by the current of air downwards through the central bores of the two coaxial hollow pins, in order to be passed out through the storage disc and advanced into the upper edge of the head of the spindle of the doubling frame, from where they are removed to start the known double twisting phase.

This invention also provides for a device for carrying out the method described hereinabove, this device comprising:

an auxiliary pin in the form of a needle fixed to the frame of the doubler and adapted to support in a transient manner the supply bobbin to be inserted in the upper hollow pin;

a head connected to a source of compressed air and having, in reciprocal cooperation, an impact surface and an injection nozzle injecting a current of compressed air;

an upper hollow pin axially displaceable under the action of a force, this upper hollow pin ending in a bushing integral therewith;

a lower hollow pin having a sleeve integral with the lower supporting seat of the expansion braking device, this sleeve being axially displaceable under the action of a force;

means for lateral displacement of the braking device, these means operating by means of an attractive force of a magnetic nature.

With reference to the above, the accompanying drawings illustrate a preferred embodiment, which is not binding and is not limited by the reciprocal positions of the components and by the consequent simplifications that can be derived therefrom.

Figure 2:
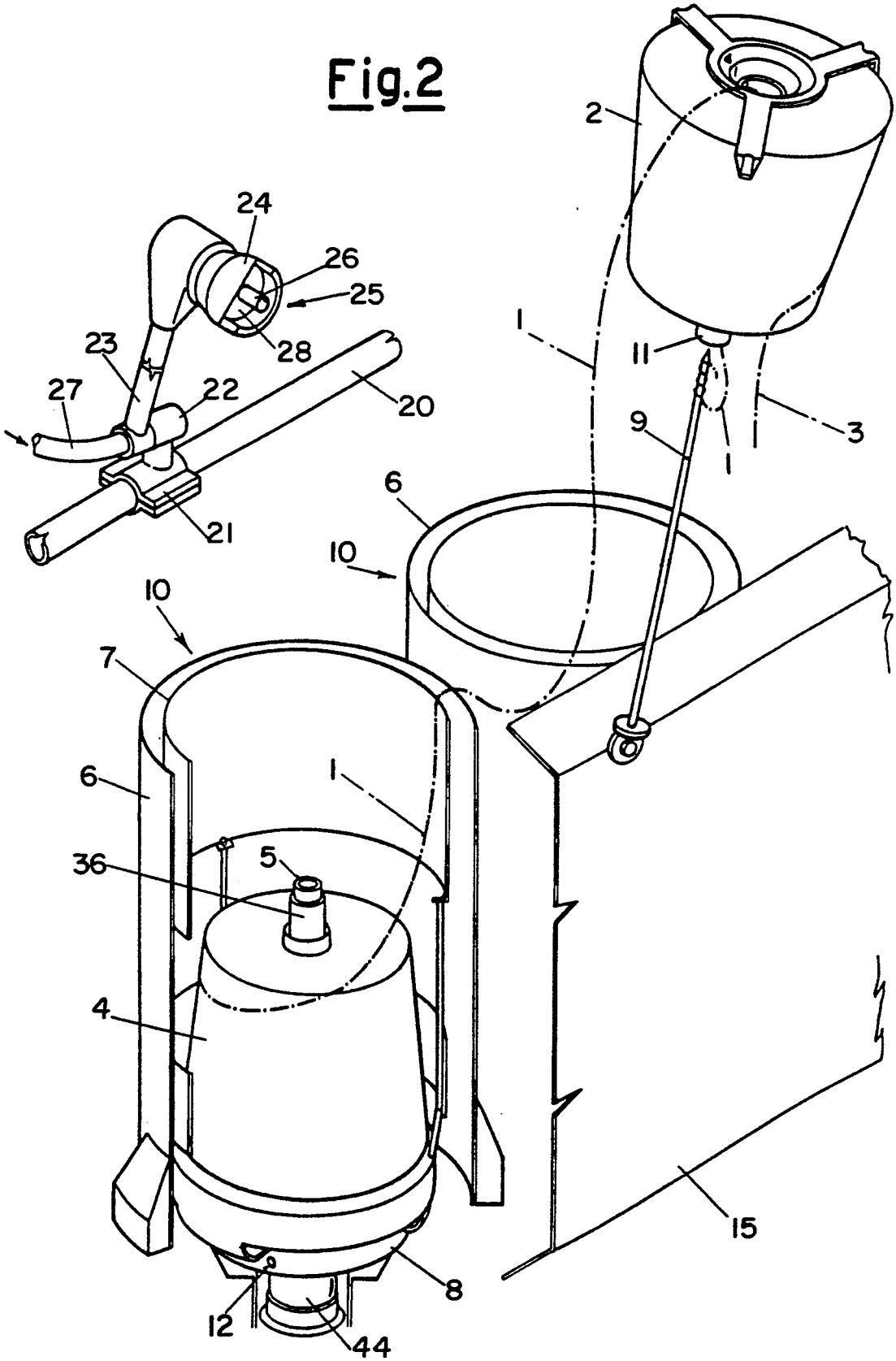
Figure 3:
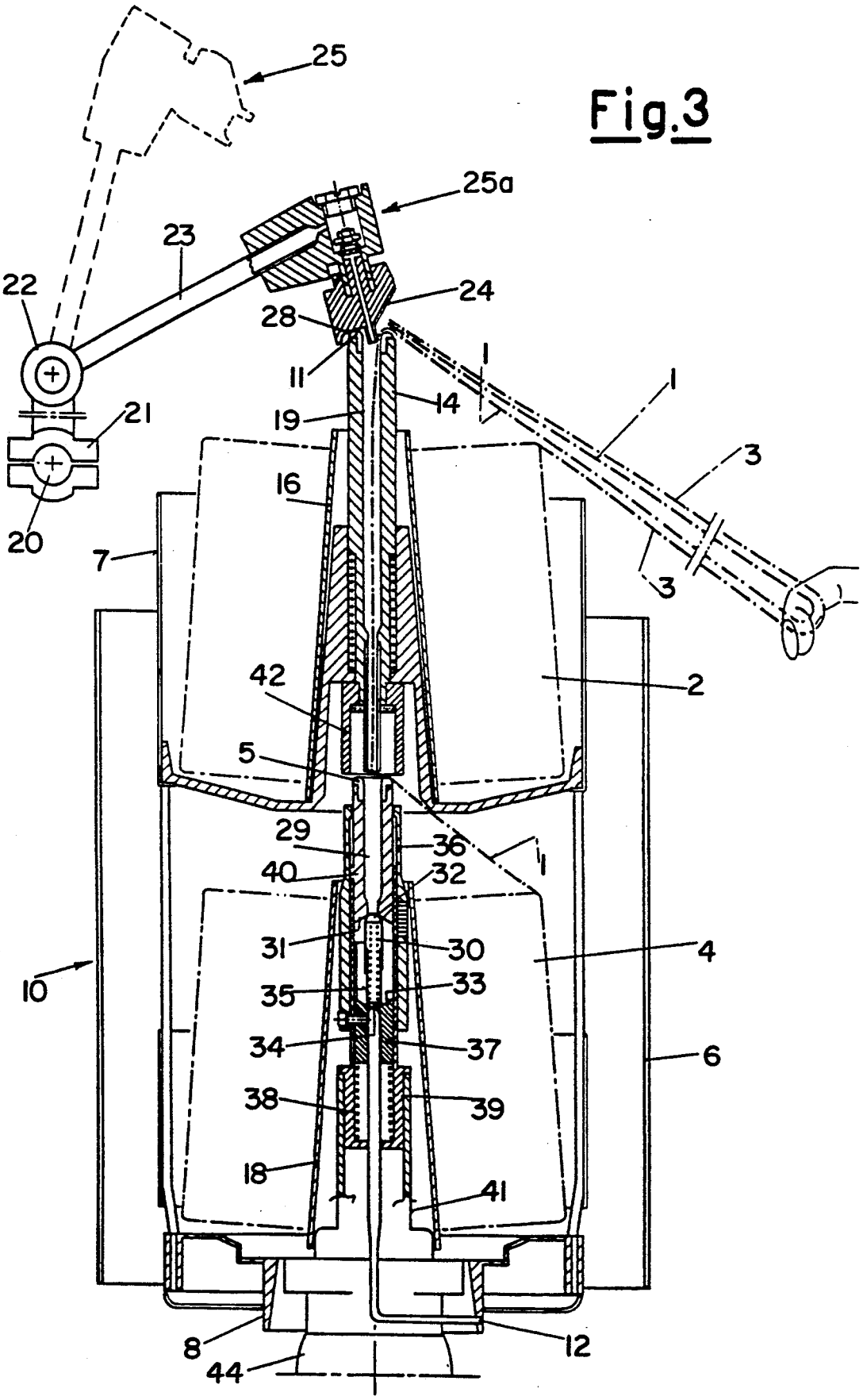
Figure 7:
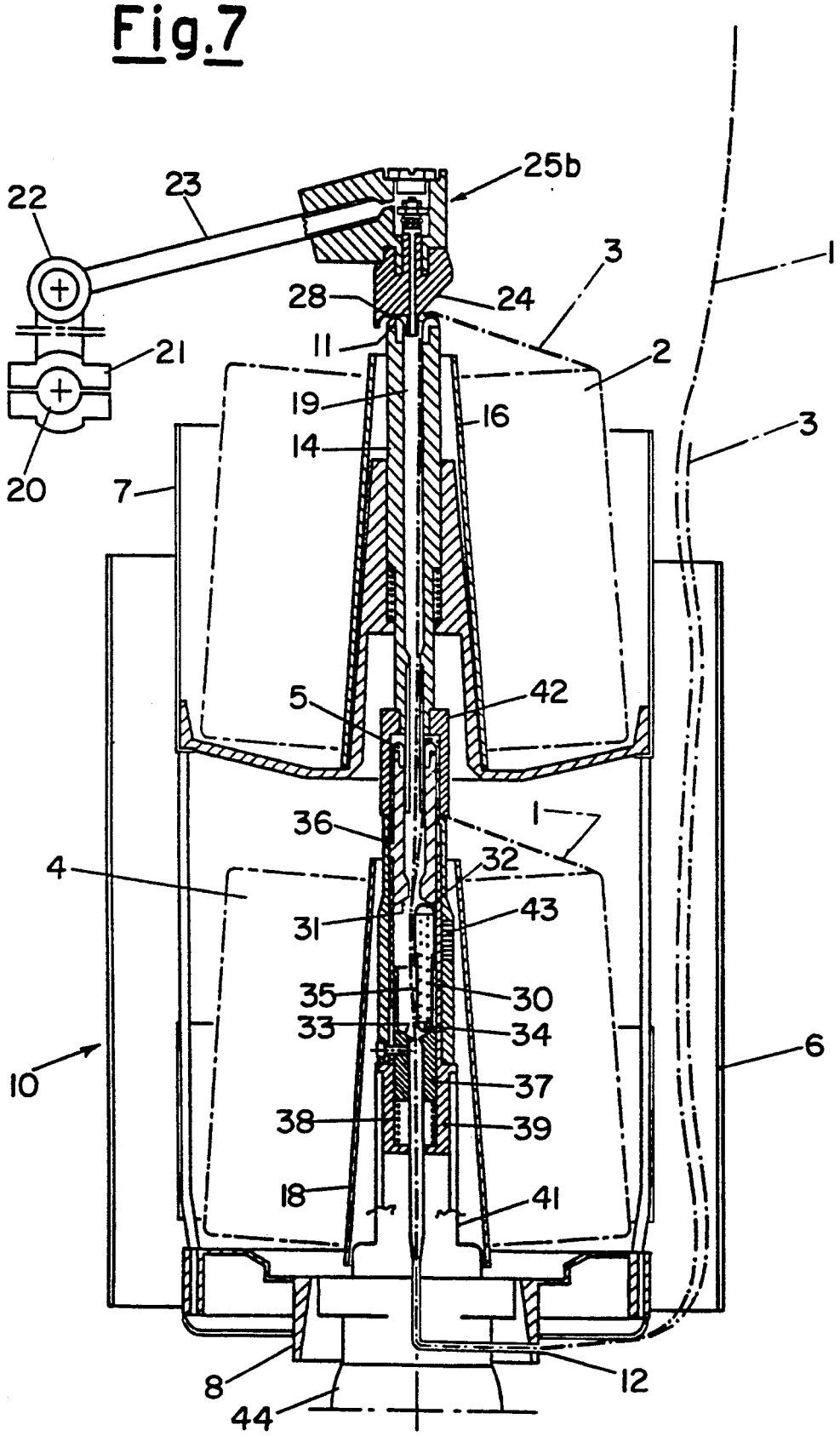
Figure 8:
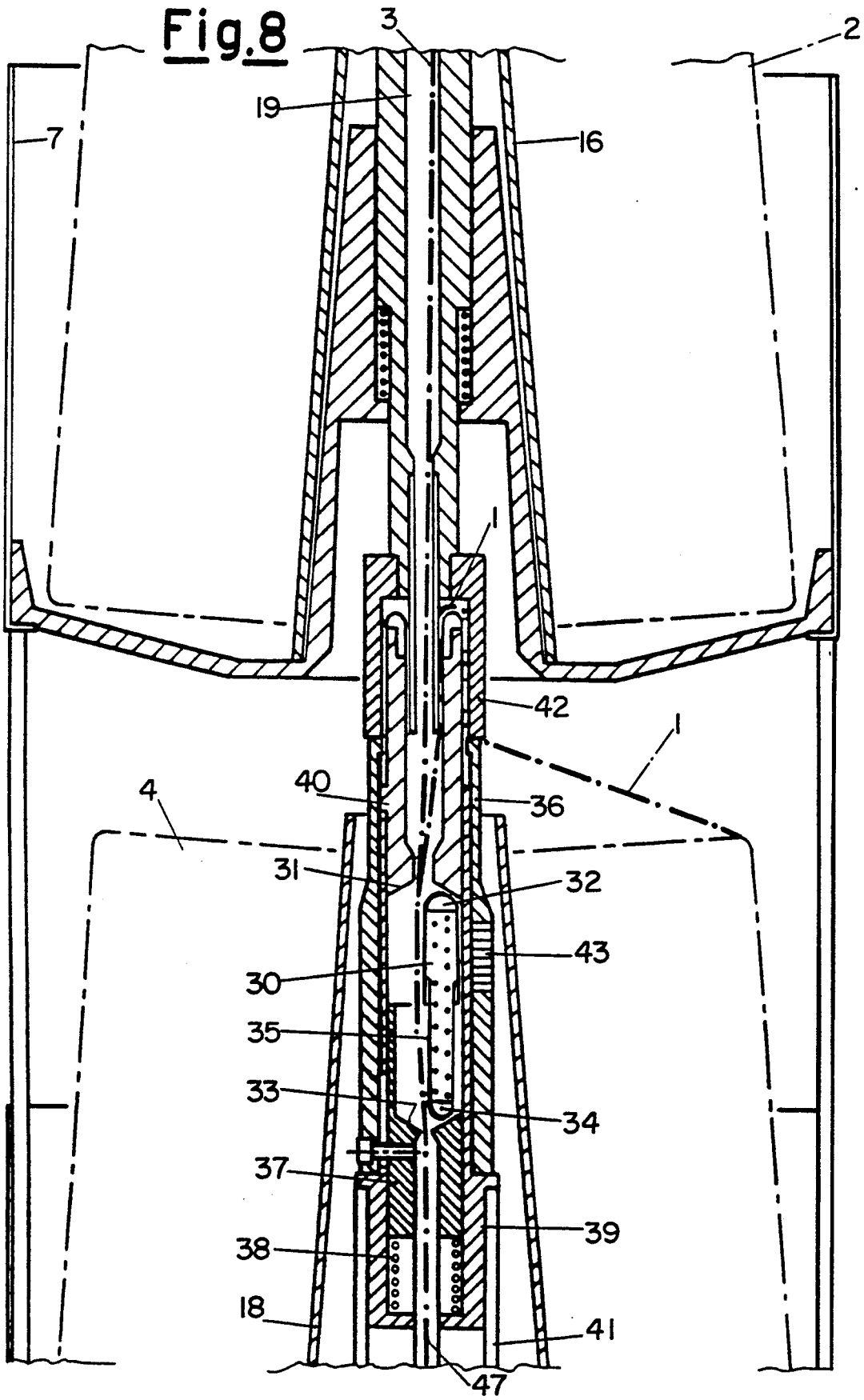

This embodiment and the associated method will now be described in more detail with reference to the accompanying drawings, in which:

FIG. 1 shows, in diagrammatic axonometric perspective, a front view, in part section, of a double hollow pin twisting spindle associated with two truncated bobbins which feed the threads for the formation of the ply yarn, this figure also illustrating the auxiliary pin in the form of a needle fixed to the frame of the doubler, the supply bobbin inserted in its own upper hollow pin already being disposed and housed transiently in said needle, this figure moreover showing a head connected to a source of compressed air and positioned in the vicinity of the spindle;

FIG. 2 shows a diagrammatic axonometric perspective of the assembly of FIG. 1 at the moment the operator lifts the upper bobbin being removed from the auxiliary pin in the form of a needle in order to advance the initial length of the thread unwound from the lower bobbin into the central bore of its own hollow pin;

FIG. 3 shows a diagrammatic axial section of the double hollow pin twisting spindle, with the lengths from the two bobbins, one above the other, in the head of the spindle and with the initial lengths unwound from the said bobbins held together at a sufficient distance from the inlet of the central bore of the upper hollow pin, this figure also showing the moment the head of the nozzle for the injection of compressed air is moved towards the inlet of the said central bore of the upper hollow pin;

FIG. 4 shows an enlarged diagrammatic axial section of the upper part of FIG. 3 and shows in more detail the contact zone between the lower surface of the head of the injector of the current of compressed air and the inlet surface of the upper hollow pin;

FIG. 5 shows an enlarged diagrammatic axial section of the upper part of FIG. 3 and shows in more detail the moment the head of the injector of compressed air forces the upper hollow pin downwards and, following this force, automatically activates its own nozzle for the injection of the current of compressed air which carries the initial lengths of thread from the two bobbins into the central bores of the two superimposed hollow pins;

FIG. 6 shows a diagrammatic section along the line A—A of FIG. 5, this figure showing the circular sector of the inlet of the central bore of the upper hollow pin free of contact with the lower impact surface of the head of the injector of the current of compressed air, the initial lengths of thread held together after being unwound from the lower supply bobbins being advanced through the said circular sector;

FIG. 7 shows a diagrammatic axial section of the double hollow pin twisting spindle with the lengths from the two bobbins, one above the other, in the head of the spindle and with the initial lengths unwound from the said bobbins already carried by the current of air through the central bores of the two coaxial hollow pins and through the bore of the storage disc so that they are in correspondence with the upper edge of the head of the spindle of the doubling frame, this figure moreover showing the two hollow pins forced downwards, one above the other, with the braking device displaced laterally;

FIG. 8 shows an enlarged diagrammatic axial section of the central part of FIG. 7 and shows in more detail the supporting seats at a great distance from the braking device which is free for lateral displacement under the action of an attractive force of a permanent magnet associated with the casing of the lower hollow pin.

In the drawings, identical elements or elements having identical or equivalent functions are designated by identical reference numerals. The method and the device described hereinafter are associated with truncated bobbins, although the invention in question can be adapted to cylindrical bobbins or bobbins of other shapes.

For the sake of clarity in the figures, all of the parts not required for an understanding of the invention are omitted, as they are already known and are not important for the operation of this invention. Referring to the accompanying drawings, the reference numeral designates the initial length of thread unwound from the lower bobbin 4, which is already positioned around the lower hollow pin 40 and in the head 7 of the spindle. The end of this initial length of thread 1 is fixed to the top of the auxiliary pin in the form of a needle 9 around which the truncated supply bobbin 2 is inserted and housed. The reference numeral 3 designates the initial length of thread unwound from the upper supply bobbin 2. The reference numeral 5 designates the upper end of the hollow pin 40, also a lower winding head into the central bore 29 of which the threads unwound from the supply bobbins 4 and 2 enter and pass in order to produce the ply yarn obtained by the spindle 10 by means of the double twisting action thereof. The reference numeral 6 designates the circular casing acting as a container for the ply yarn balloon during the twisting process, as is well known in the art. The reference numeral 7 designates the container head of the superimposed feeding bobbins, rotation of which is prevented by means of holding magnets (not shown). The reference numeral 8 designates the thread storage disc of the spindle 10, known per se. The reference numeral 12 designates the bore of the conduit through which the threads 1 and 3 emerge from the storage disc 8. The reference numeral 11 designates the upper end of the hollow pin 14, also an upper winding head, into the central bore 19 of which the thread 3 passes during the twisting process. The reference numeral 15 designates the front frame of the twisting spindles 10 which are positioned one after the other in order to form the entire front of the doubler. The reference numerals 16 and 18 designate the conical tubes of the supply bobbins, these tubes effecting centering of the bobbins around the respective hollow pins. The reference numeral 20 designates the longitudinal support element of the head 25 which operates the pneumatic threading, pushing the hollow pins downwards and injecting compressed air through an injection nozzle. The reference numeral 21 designates the clamp fixing the head 25 to the element 20. The reference numeral 22 designates the fixed element of any known joint allowing for downward rotation of the head 25. The reference numeral 27 designates the conduit connected to the compressed air system for supplying the injection nozzle 26 through the section of the tubular element 23. The reference numeral 24 designates the angular surface portion allowing for the entry and passage of the initial lengths of wound thread 1 and 3 into the bore 19 of the hollow pin 14 during the pneumatic threading operation. The reference numeral 28 designates the impact surface portion of the head 25 which, pressing on the upper end 11 of the hollow pin 14, pushes downwards the lower supporting seat 33 of the braking device 30. The reference numeral 44 designates the pulley, the rotating part of the spindle 10, known per se, being rotatably mounted thereon.

This pulley 44 is generally set in rotation by means of a notch, or by various other known drive systems not important to the invention. The reference numeral 30 designates the expansion braking device for the control of the tension of the thread in the interior of the spindle. In this case, the object illustrated in the drawings is an expansion olive, already known in the art, consisting of two cylindrical elements 32 and 34 disposed axially and held in a supporting position pressed between the seats 31 and 33 by the elastic force of a helical spring 35 advantageously housed in the interior thereof. The reference numeral 36 designates a sleeve surrounding the lower hollow pin 40, wherein this sleeve 36 can be displaced and is integrally connected to a hollow pin 37, the cavity of which forms the lower supporting seat 33 of the cylindrical element 34 of the braking device 30. The reference numeral 38 designates a helical spring housed in the cavity of the fixed bushing 39, which is supported by the fixed tubular element 41 of the spindle 10. This helical spring 38 exerts a continuous upward force on the lower surface of the hollow pin 37. The reference numeral 42 designates the end bushing of the upper hollow pin 14. This bushing 42 is integrally connected to the lower end of the hollow pin 14 and when displaced axially downwards moves towards the upper part of the sleeve 36 forcing it to be displaced axially downwards. The reference numeral 46 designates the conduit which directs compressed air into the injection nozzle 26 at the moment this conduit 46 is displaced upwards in order to bring it into communication with the pressurised zone 45, compressed air always being present in this zone. The reference numeral 43 designates the permanent magnet inserted into the thickness of the sleeve 36 which surrounds the lower hollow pin 40, this permanent magnet 43 being displaced axially downwards, so that it assumes a front position relative to the braking device 30. The reference numeral 47 designates the double yarn of the initial lengths of wound thread 1 and 3.

The operation of the device for carrying out the method according to this invention will now be described with reference to the accompanying drawings, showing one structural arrangement operated in an intuitable manner.

It will be assumed that a spindle 10 is supplied with truncated supply bobbins 2 and 4 which must feed the threads 1 and 3 in order to produce the ply yarn.

The bobbin 4 is inserted into the hollow pin 40, this bobbin 4 being centered and housed around the lower winding head in the head 7 of the spindle 10. A sufficiently long initial length of thread 1 unwound from the said supply bobbin 4 is removed. The end of this initial length of thread 1 is fixed around the point of the auxiliary pin in the form of a needle 9. Beforehand, the truncated supply bobbin 2, already centered and housed in its hollow pin 14 provided on the upper winding head of the twisting spindle 10 is inserted into the pin 9.

When inserted into the pin 9, the truncated bobbin 2 is placed with its larger base facing upwards, as illustrated in FIG. 1.

For removal, the bobbin 2 is lifted from the pin 9 in order to be inserted into the head 7 of the spindle 10 in a superimposed position relative to the lower bobbin 4. During the said removal 1, the end remaining fixed to the point of the pin 9, it is advanced into the central bore 19 of the hollow pin 14. The two bobbins 2 and 4, are therefore superimposed and lie with their tapers directed upwards, i.e. each facing the same way with the smaller diameter facing upwards.

The initial length of thread 3 unwound from the upper supply bobbin 2 is removed and held together with the initial length of thread 1 which is released from its fixed position on the pin 9. These initial lengths of thread 1 and 3 are advantageously held manually by the operator charged with controlling the pneumatic threading (see FIG. 3).

The ends of the initial lengths of thread 1 and 3 rest on the inlet 11 of the central bore 19 of the hollow pin 14. The head 25 is displaced and moves towards the inlet 11 of the central bore 19, and is rotated into the position 25*a*. The head is forced downwards. The impact surf ace 28, in contact with the end 11, forces the hollow pin 14 to descend, together with the end bushing 42.

As the bushing is displaced downwards, it is already pushed into the sleeve 36 and, therefore, the hollow pin 37, the internal cavity of which forms the lower supporting seat 33, which, descending, leaves the device 30 free to be attracted laterally by the permanent magnet 43, located in a front position relative to the said device 30. The permanent magnet 43 integral with the sleeve 36 is in fact also displaced downwards. At this moment, the central bores 19 and 29 of the two superimposed coaxial hollow pins 14 and 40 are free for the passage of the initial lengths of thread 3 and 1 unwound from the respective supply bobbins 2 and 4. In the next instant, the head 25, increasing the downward force, assumes the position 25*b* of FIG. 5 and FIG. 7, and in this precise instant, this thrust force overcomes the force generated by the compressed air at the block of the injection nozzle 26, the conduit 46 being displaced upwards and entering into communication with the zone 45 in which the compressed air is located. This compressed air passes through the said conduit/and the conduit of the nozzle 26 creates a strong current of air which carries the initial lengths of thread 1 and 3 downwards along the central bores 19 and 29 of the two coaxial hollow pins so that they emerge from the storage disc 8 through the bore of the conduit 12. The said current of air advances them to the upper edge of the head 7 of the spindle 10 of the doubling frame, from where they are removed by the operator to start the known double twisting phase. The head 25 is raised and returned to its initial superimposed position at the side of the twisting spindle 10 ready to repeat the pneumatic threading in the double hollow pin spindle. Any relevant modifications are possible, and thus the elements described and illustrated can be substituted by other equivalent elements, without thereby going beyond the scope of the inventive idea as claimed hereinabove.

The relevant terminology such as "upper" and "lower" etc. is adopted in the description and/or in the claims only to describe the relation of certain elements with respect to others when the twisting spindle in its normal vertical position, and must not be viewed as limiting the elements to these precise positions.

We claim:

1. A method for pneumatically threading in a path, a double twisting doubling frame having a double hollow pin twisting spindle for producing a multi-ply yarn, wherein the spindle has a first and a second thread feeding bobbin coaxially disposed and positioned on respective hollow pins in the head of the spindle, wherein the bobbins engage their respective hollow pins by having the thread unwound from the bobbins directly enter their respective hollow pins, and wherein the method comprises:

a) removing an initial length of thread from the first bobbin positioned on its respective hollow pin in the head of the spindle for insertion into the second bobbin hollow pin;

b) removing an initial length of thread from the second bobbin positioned on its respective pin for holding with said length of thread from the first bobbin, while the second bobbin is inserted into the head of the spindle;

c) placing said held lengths of thread on the hollow at the end of the second bobbin hollow pin;

d) moving a compressed air means towards the hollow at the end of the second bobbin hollow pin;

e) displacing the second bobbin hollow pin along its longitudinal axis by said compressed air means thereby laterally displacing a braking means for controlling the thread tension away from the thread path, wherein said braking means is located in the thread path along the longitudinal axis of the first and second bobbin hollow pins and therebetween, so that the thread may be directed in the thread path and into the hollow of the first bobbin hollow pin; and f) injecting compressed air from said compressed air means for transporting the lengths of thread from the first and the second bobbins through the hollows of the first and the second bobbin hollow pins and advancing said lengths of thread into the head of the spindle for starting the formation of the multi-ply yarn.

2. A device for pneumatically threading in a path, a double twisting frame having a double hollow pin twisting spindle for producing a multi-ply yarn, wherein the spindle has a first and a second thread feeding bobbin coaxially disposed and positioned on respective hollow pins in the head of the spindle, wherein the bobbins engage their respective hollow pins by having the thread unwound from the bobbins directly enter their respective hollow pins, wherein the device comprises:

a) a pin fixed to the frame adapted for supporting the second bobbin when placing the second bobbin on its respective hollow pin;

b) compressed air means having an impact surface and an injection nozzle with reciprocating cooperating therebetween for injecting a stream of air through the hollow of the hollow pins;

c) a bushing integral with the second hollow pin, wherein the second hollow pin is displaceable along its longitudinal axis;

d) braking means for controlling the thread tension, wherein said braking means is located along the longitudinal axis of the hollow pins and therebetween, and wherein said braking device has a supporting seat and is laterally displaceable, and wherein the first bobbin hollow pin has a sleeve integral with said seat; and e) displacing means for said lateral displacement of said braking means.

3. The device of claim 2, wherein said displacing means has magnetic force for laterally displacing said braking means.

* * * * *